United States Patent [19]

Skaugen

[11] 4,299,655

[45] Nov. 10, 1981

[54] FOAM GENERATOR FOR PAPERMAKING MACHINE

[75] Inventor: Borgeir Skaugen, Beloit, Wis.

[73] Assignee: Beloit Corporation, Beloit, Wis.

[21] Appl. No.: 146,677

[22] Filed: May 5, 1980

Related U.S. Application Data

[63] Continuation of Ser. No. 886,277, Mar. 13, 1978, abandoned.

[51] Int. Cl.[3] ..... D21F 1/06

[52] U.S. Cl. ..... 162/343; 162/380; 366/101; 366/336

[58] Field of Search ..... 162/101, 216, 322, 336, 162/343, 344, 315, 380; 366/336, 101

[56] References Cited

U.S. PATENT DOCUMENTS

| | | | |
|---|---|---|---|
| 2,481,959 | 9/1949 | Wahlin | 162/101 |
| 3,716,449 | 2/1973 | Gatward et al. | 162/101 |
| 3,802,960 | 4/1974 | Spengos et al. | 162/216 |
| 3,871,952 | 3/1975 | Robertson | 162/101 |
| 3,937,273 | 2/1976 | Raduan et al. | 162/216 X |
| 4,021,296 | 5/1977 | Reiner | 162/216 X |

FOREIGN PATENT DOCUMENTS

| | | | |
|---|---|---|---|
| 1395757 | 5/1975 | United Kingdom | 162/322 |

*Primary Examiner*—Richard V. Fisher

*Attorney, Agent, or Firm*—Hill, Van Santen, Steadman, Chiara & Simpson

[57] ABSTRACT

A mechanism to be used in the generation and maintenance of a surfactant foam having fibers distributed therethrough with the foam to be used in the formation of a fibrous web by being deposited on a porous forming surface and particularly a unit for dispersing and mixing fluids provided with a flow path including an upstream conduit and a downstream conduit and a housing therebetween defining a dispersing and mixing chamber with a plug therein providing venturi chambers, and in one form having a washboard corrugated path on the upstream side wherein the foam is provided with controlled surfactant and air and in the zones of reduced pressure caused by the venturi shape expansion, the fibers are distributed and the air is distributed throughout the surfactant in a uniform manner.

10 Claims, 8 Drawing Figures

FOAM GENERATOR FOR PAPERMAKING MACHINE

This is a continuation of application Ser. No. 886,277, filed Mar. 13, 1978, now abandoned.

BACKGROUND OF THE INVENTION

The present invention relates to improvements in structures for forming a fibrous web from a suspension of fibers in a stock, and more particularly to a mechanism for preparing the stock and improving the dispersion and mixing of air in a surfactant foam and distributing the fibers throughout the foam. More basically, the invention relates to an improved mixing and dispersion device capable of improved ingestion of one fluid in another which is particularly well adapted and provides unique advantages in a foam generating system.

In the manufacture of fibrous webs, particularly from synthetic fibers, one method which has been developed involves suspending the fibers in a foam suspension. The system for one such arrangement is disclosed in U.S. Pat. No. 3,716,449.

In handling the foam generated by the process taught in the aforesaid patent, a requirement is that the foam not be permitted to break down so that the fibers are uniformly carried and uniformly distributed. To accomplish this the foam must be uniform and even uniform to the extent of having uniform bubble formation, and this can be accomplished by continual regeneration of the foam in its flow through the system toward the forming surface.

One very critical area when working with long synthetic fibers is that the location and the method employed for fiber addition. In a conventional paper machine, the wood fibers are added at the suction side of the fan pump, and the turbulence created by the pump disperses the fibers. On specialty grades, however, where longer than normal paper making fibers are utilized, this method cannot be used because the fibers would plug up the pump or become entangled with each other and with mechanical surfaces in the system. An important function of the mechanism is to obtain adequate and complete diffusion. This involves difficulty in machines that require different flow rates for different grades. A feature of the present invention is the provision of a mechanism which attains a unique result in that it provides structure which is capable of controlling the flow rate, which structure coacts to provide improved diffusion.

The diffusion mechanism of the invention may also be utilized as a mixer. Such mixers find use in the ingestion of dies and chemicals introduced into a liquid. Such mixing is utilized particularly in the paper industry, but also in the food processing and chemical industries. The ingestion, mixing and diffusion of fibers into a flowing liquid line is necessary wherein the fibers are picked up by water to be mixed in stock and is also necessary wherein the fibers are to be suspended in a surfactant foam rather than water. The features of the present invention may be employed in both types of systems.

It is an object of the present invention to provide an improved mixing and diffusion method and apparatus which employs the factors inherent in a flowing stream for the diffusion function by the structural relationship of parts.

A further object of the invention is to provide an improved diffusion and mixing apparatus which is particularly well adapted to the mixing and distribution of long fibers in a liquid in a paper making machine.

A further object of the invention is to provide an improved diffusion apparatus which functions for the continual regeneration of foam in a foam system suspending fibers in a surfactant foam.

Other objects, advantages and features will become more apparent, as will equivalent methods and structures which are intended to be covered herein, in connection with the teaching of the principles of the present invention in the disclosure of the preferred embodiments of the invention in the specification, claims and drawings in which:

DRAWINGS

DESCRIPTION

Figure 1:
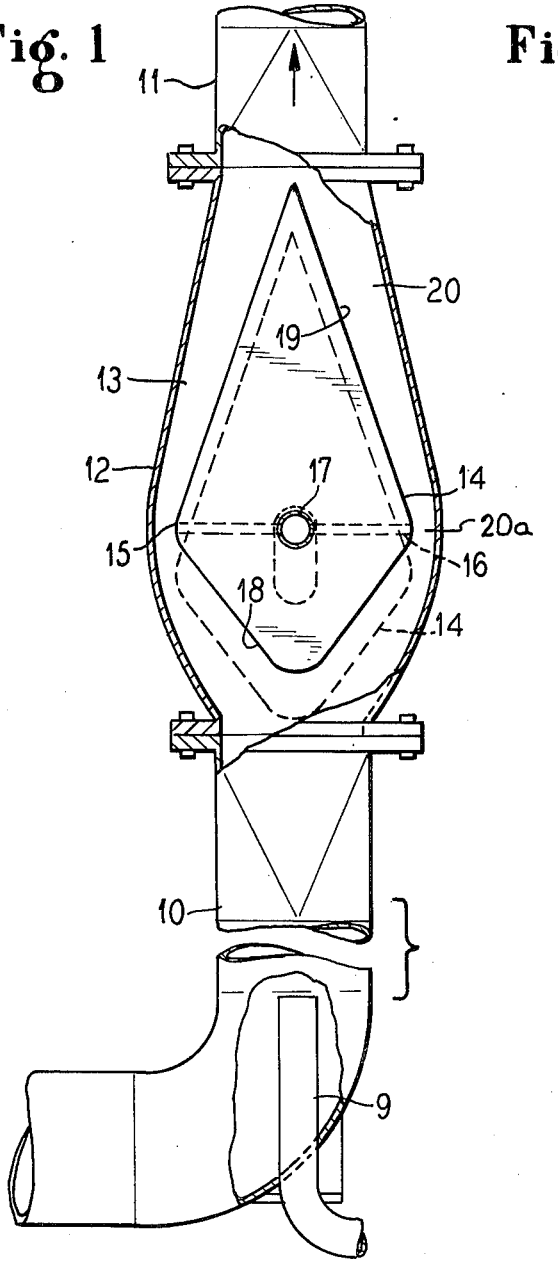
FIG. 1 is a side elevational view in schematic form illustrating a mixing and diffusing apparatus constructed and operating in accordance with the principles of the present invention.
Figure 2:
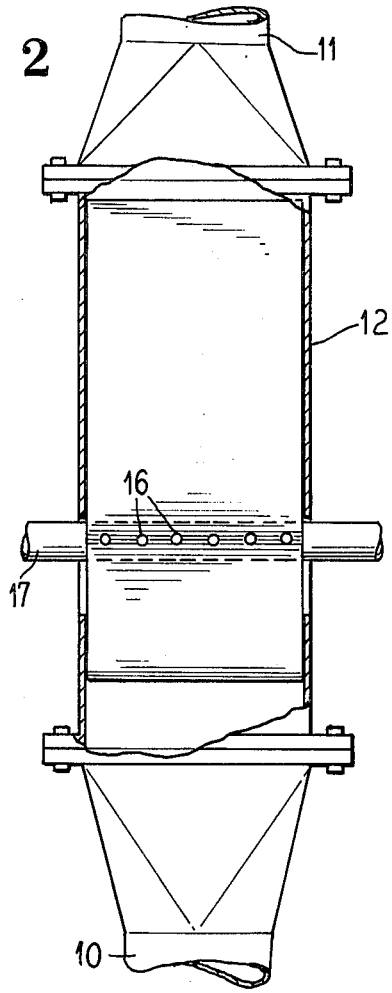
FIG. 2 is a front elevational view also in schematic form of the mechanism of FIG. 1.

FIGS. 1 and 2 show an upstream conduit for conducting the desired liquid such as white water in a paper making machine. A heavy stock line 9 of smaller diameter enters through the wall of the upstream conduit 10 with a discharge nozzle centrally located in the upstream conduit 10 for distributing long fibers into the flowing white water. The white water is delivered as indicated by the arrowed line to the conduit 10 from the fan pump or similar pressure pump, and the downstream flow of mixed water and fibers will be delivered to a headbox, and for this purpose, a downstream conduit 11 is provided.

Intermediate between the upstream conduit 10 and downstream conduit 11 is a housing 12 having a dispensing and mixing chamber 13 therein. Within the housing is a shaped plug 14. The plug is streamlined and tapered on its upper end 18 and tapers to an air foil diminishing thickness shape 19 on its downstream end. The upstream end 18 acts in coaction with the wall of the housing 12 to limit or control the flow of liquid from the upstream conduit. For this purpose, the plug is adjustably movable in the direction of flow of the liquid, for example, from the solid line to the dotted line position of FIG. 1, to act as a valve to control the quantity of flow. The plug and housing together form an expansion and dispersion chamber zone 20 on the downstream end so that in essence the flow path of the liquid through the housing 12 is in the shape of a venturi. The constricted portion of the venturi is formed between the plug and the wall at 20*a*, and the expansion portion of the venturi is formed between the housing wall and plug at 20. The expansion and dispersion zone 20 is an area of decreased pressure, and it has been discovered that it is the area of decreased pressure which causes dispersion and distribution of the long fibers. The smooth plug and its chamber wall do not cause any hang-up of fibers even if they are heavy fibers of the long type.

It may be desirable to provide an alternate or a supplemental heavy stock supply, and this is provided through the plug itself. A stock input line 17 leads laterally into the plug and the plug has a series of passages terminating in openings 16 and 15 at the outer surface of the plug and to the passage between the plug and the chamber wall. The chamber will be shaped as it is shown in its profile in FIG. 1, with the ends of the chamber flat as shown in FIG. 2. The insides of the chamber are similarly shaped with the chamber wall shown as a single line in the drawing for convenience of illustration. The plug will be shaped in profile as shown in FIG. 1 with its ends flat, and suitable sealing apparatus will be provided for the inlet line 17 at the end of the plug, and the plug will be provided with means for securing it in its position within the chamber and permitting adjustment in its location in the direction of stream flow.

Figure 3:
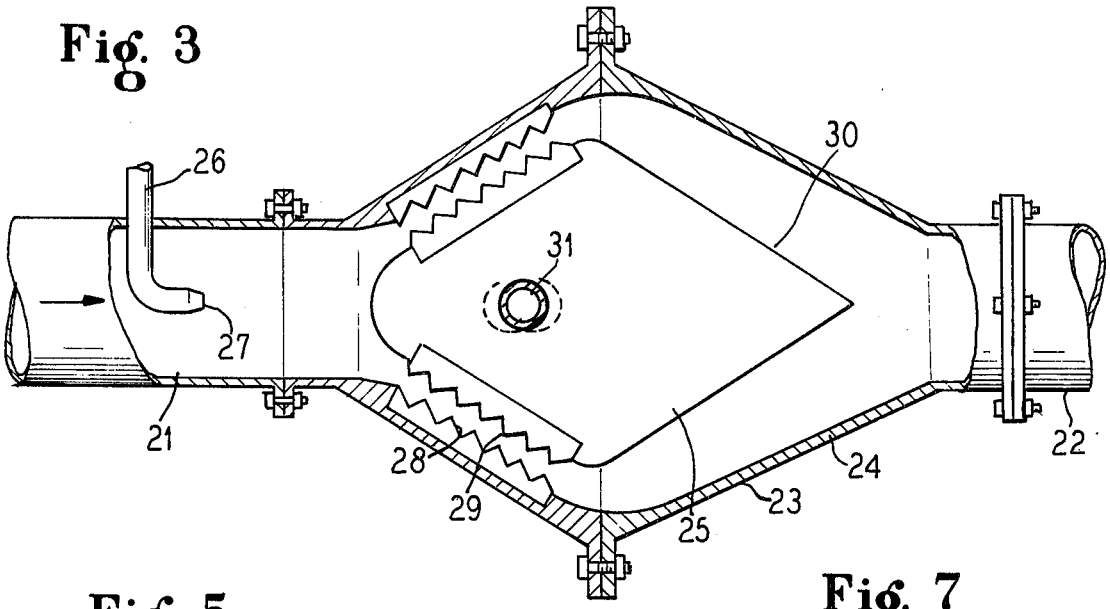
FIG. 3 is a schematic sectional view illustrating the interior of a mixing and diffusing apparatus of a form different than the mechanism of FIGS. 1 and 2.

FIG. 3 illustrates another form of the mechanism utilizing in a more complex form the venturi principle of reduced pressure which has been found to provide the unique dispersion results effective on dispersion of fibers in a flowing liquid. The arrangement of FIG. 3 while it may be employed for the dispersion of fibers in a water, is particularly well suited for the dispersion of fibers in a foam, and for the regeneration of foam in its flow to a headbox.

An upstream line 21 is provided with a flow of foam therethrough as indicated by the arrowed line. The foam will be pregenerated by a generating apparatus, and usually fibers will be distributed throughout in the generating apparatus or in auxiliary apparatus. An input line 26 is provided with a discharge nozzle 27 centrally located in the upstream line 21. While this input line 26 may be also utilized for the ingestion of additional fibers into the system, preferably it will be used for the controlled input of air and in some instances, additional surfactant so that the additional foam regeneration can occur.

The foam regeneration, and the distribution and dispersion of fibers occurs within a housing 23 which receives flow from the upstream line 21 and delivers flow to a downstream conduit 22. The housing has a chamber 24 shaped as illustrated which is flat on its ends, and within the chamber is located a movable plug 25 which is adjustable in the direction of the arrowed line shown extending in each direction from a central support 31. Again, the member 31 may be a supporting shaft provided with suitable mechanism for adjusting the plug upstream or downstream in the direction of liquid flow with suitable seals provided between the shaft 31 and the housing 23. The plug in being adjustable controls the volume of flow, and is tapered on its downstream end 30 to provide an expansion chamber with the reduction of pressure that improves distribution and dispersion.

The primary foam regeneration and distribution and dispersion occurs on the upstream side of the plug which is provided with a washboard effect. That is, the inner wall of the housing 23 is provided with a series of recurring corrugations 28 which extend laterally across the direction of stream flow, and a corresponding mating, facing series of corrugations 29 are provided on the surface of the plug which faces the housing. Both sides of the plug on the upstream side and both sides of the chamber on the upstream side have similar corrugations for the so-called washboard effect. The peaks of the corrugations are preferably generally in opposed relationship so that the corrugations in effect form a series of venturis or constrictions each followed by an expansion area. Thus, the repeated constriction and expansion, and the consequent increase in pressure and decrease in pressure which occur in accordance with the venturi principle effect a regeneration of the foam flowing therethrough.

The shifting of the plug 25 in the direction of stream flow will bring the corrugated surfaces closer together or further apart thus effecting a control in the pressure buildup and drop of the liquid as it flows through the washboard zone. Generally, a pressure drop on the order of 25 psi has been found to be desirable for the development of the proper air content and quality of the foam, and adjustment of the plug can be made to achieve this. A pressure drop in the range of 20 to 30 psi is preferred. The type of surfactant used may be selected in accordance with the circumstances of operation for the formation of a fibrous web and the type of surfactant employed may be of any general type such as those illustrated in the publication "Encyclopedia of Surface Active Agents" by Seisley and Wood, published by Chemical Publishing Company, New York, Copyright 1964.

Figure 4:
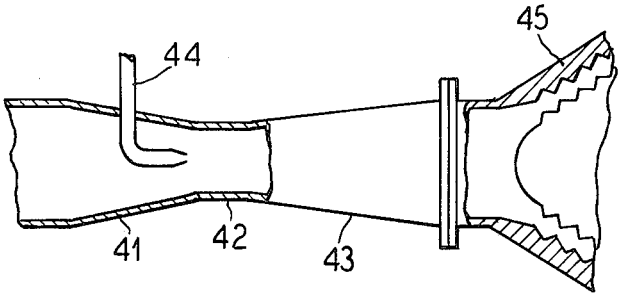
FIG. 4 is a schematic side elevational view of still another form of the apparatus.

FIG. 4 illustrates another form of regenerator utilizing the mechanism of FIG. 3. In FIG. 4, an upstream line 41 carries the foam and controlled alternate air or surfactant is introduced by a line 44 delivering into the center of the upstream line. A restricted venturi portion 42 is provided in the upstream line 41 with this followed by an immediate venturi expansion portion 43. The expansion portion is followed by an expansion chamber arrangement shown at 45 which will be of the construction shown in FIG. 3.

Figure 5:
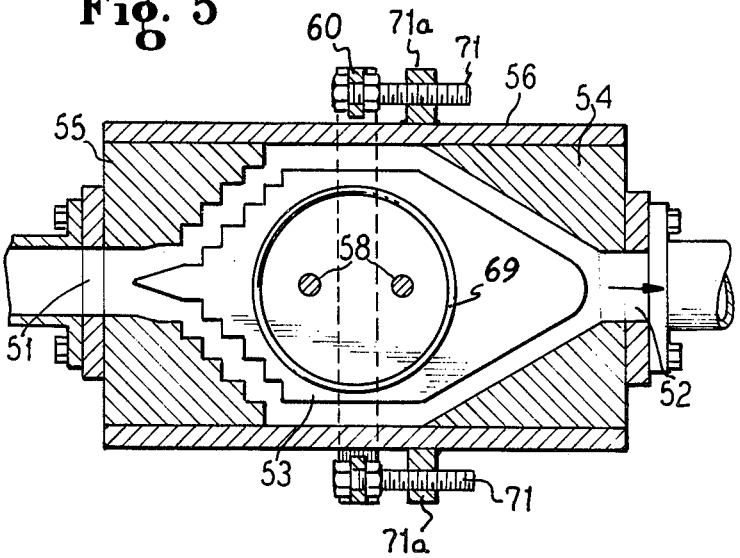
FIG. 5 is a vertical sectional view taken through a mixing and diffusing apparatus such as that illustrated in FIG. 3 and shown in less schematic form than FIG. 3.
Figure 7:
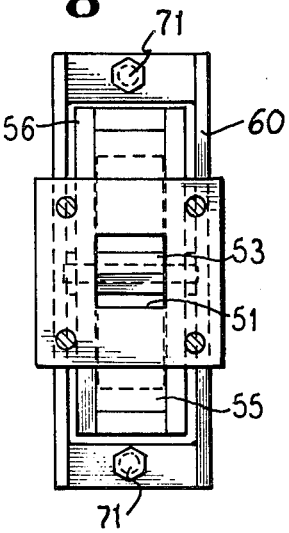
FIG. 7 is an elevational view taken substantially along line VII—VII of FIG. 6.
Figure 6:
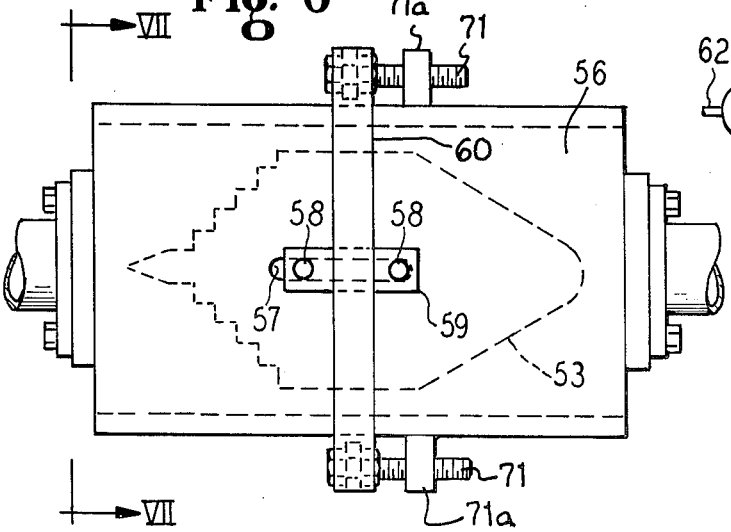
FIG. 6 is an elevational view of the structure of FIG. 5.

FIGS. 5 through 7 illustrate a mechanism similar to FIG. 3 in less schematic form. Stock enters the housing shown generally in the figures through an inlet line 51, flows out through an outlet line 52. The housing is enclosed by an outer rectangular sleeve 56, and the sections of the interior of the housing are separable so as to be able to locate a plug 53 in the hollow chamber therein with the walls of the housing formed on the upstream side at 55 and at the downstream side at 54.

The plug 53 is supported on cross shafts 58 which extend through the outer wall or sleeve 56 through a slot 57, and the ends are set in plates 59. The plug can be adjusted manually upstream or downstream to its desired location. The plug 53 is relatively flat on its sides with an O-ring 69 sealing the flat sides against the housing but permitting adjustment. For adjustment, a band 60 is secured to the plates 59 and the band is moved by rotation of adjustment bolts 71 rotatable in the band and threaded into lugs **71*a* fixed to the sleeve 56**.

Figure 8:
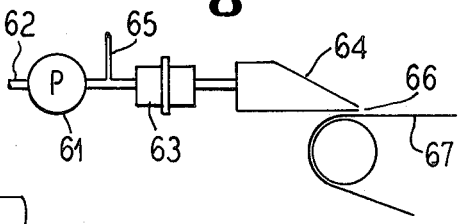
FIG. 8 is a schematic view illustrating the mixing and diffusing apparatus in combination with a web forming machine.

FIG. 8 shows the dispersion distribution arrangement used in a paper making machine wherein foam or white water is delivered through an upstream line 62 through a pump which is a fan pump 61 with the flow of liquid delivered to a dispersion distribution chamber 63 which has the construction of the various arrangements such as shown in FIGS. 1, 3 or 4. A long fibered stock, or controlled air and surfactant is delivered by a line 65.

The stock with the suspended fibers flows to a headbox 64 and out through a slice opening 66 onto a traveling forming surface 67 wherein the liquid passes through the forming surface and the distributed fibers form a mat on the traveling forming surface.

In operation of the arrangements illustrated in FIGS. 1, 3 and 4, a liquid carrier such as water or foam passes into a distributor dispersion device and the device subjects the liquid to passage through one or more of a series of venturi chambers with the drop in pressure that occurs in the liquid causes a regeneration of foam and/or a distribution of the fibers.

Thus, it will be seen that I have provided a device and method which achieves the objectives set forth and provides for an improved versatility over a wide range of requirements and flow conditions and improves the resultant product.

I claim as my invention:

1. A dispersing and mixing unit for a paper making machine comprising in combination:

an upstream conduit for conducting delivered liquid;

a downstream conduit for receiving and conducting the liquid after being mixed with a material;

means defining a mixing and dispersing chamber connected between said conduits and having opposed walls with at least one wall having corrugations extending laterally of the flow direction to define a series of constriction and expansion locations in the flow path through the mixing chamber whereby material is dispersed in the liquid in said expansion locations;

means for delivering material to be dispersed in the liquid connected to said upstream conduit; and a movable forming surface for receiving liquid from the downstream conduit to form a fibrous web on the forming surface.

2. A dispersing and mixing unit for a paper making machine constructed in accordance with claim 1:

wherein said chamber contains a plug and said plug is a teardrop shaped with a downstream section of decreasing dimension so that an expansion zone is formed adjacent the downstream surfaces of the plug.

3. A dispersing and mixing unit for a paper making machine constructed in accordance with claim 2:

including means for adjustably changing the position of the plug in the chamber in the direction of liquid flow.

4. A dispersing and mixing unit for a paper making machine constructed in accordance with claim 1:

wherein the liquid flowing through the conduits and chamber is a surfactant foam, and said means for delivering the material injects a controlled amount of air or fibers into the foam for uniform foam generation and fiber distribution within said dispersion portion.

5. A dispersing and mixing unit for a paper making machine constructed in accordance with claim 1:

wherein both opposing walls of said dispersing chamber have corrugations extending laterally of the flow with the peaks of the corrugations being generally in alignment on opposing walls.

6. A dispersing and mixing unit for a paper making machine constructed in accordance with claim 5:

including means for moving said walls relatively in a direction toward or away from each other to change the size of the expansion locations.

7. A dispersing and mixing unit for a paper making machine constructed in accordance with claim 5:

wherein said mixing and dispersing chamber is formed within a housing having one of said walls;

and a movable plug located in said housing providing the other of said walls with the plug having said corrugations on an upstream side facing corrugations on the housing wall.

8. A dispersing and mixing unit for a paper making machine in a mechanism for forming a fibrous web by depositing fibers out of a liquid foam suspension comprising in combination:

means defining a flow path including an upstream conduit for conducting a delivered foam liquid;

a pressure pump for driving the foam liquid through said flow path;

a headbox with a slice chamber with a slice opening;

a movable forming surface positioned to receive the foam liquid from the slice opening with a fibrous web forming on the forming surface;

a dispersing and mixing chamber positioned in the flow path receiving liquid from the upstream conduit and connected to deliver the liquid to the headbox including a plug positioned in said mixing chamber defining a flow path between the chamber wall and plug which path forms a venturi with a venturi constriction and a venturi expansion portion with the expansion portion of the venturi generating a distribution and dispersion pattern in the foam liquid;

means for delivering a surfactant foam to said pump;

means for mixing fibers in said foam;

and means having an opening into said upstream conduit for delivering a controlled amount of air to said foam in advance of the venturi for ingestion of the air into the foam in the mixing chamber.

9. A dispersing and mixing unit for a paper making machine in a mechanism for forming a fibrous web by depositing fibers out of a liquid suspension constructed in accordance with claim 8:

including means for adjusting the position of said plug upstream or downstream in the direction of flow to vary the shape of said venturi.

10. A dispersing and mixing unit for a paper making machine constructed in accordance with claim 9:

wherein said means for delivering the air includes passage means leading into said plug with release openings in the plug surface for discharge into the housing chamber.

* * * * *